US006439434B2

(12) United States Patent
Johansson et al.

(10) Patent No.: US 6,439,434 B2
(45) Date of Patent: Aug. 27, 2002

(54) DISPENSER FOR COLD DRINKS

(75) Inventors: Hans Johansson, Bjärred (SE); Ulf Mansson, Berlin (DE); Erwin Weidinger, Attnang-Puchheim (AU)

(73) Assignee: CM Beverage Dispenser System AB, Dalby (SE)

( * ) Notice: Subject to any disclaimer, the term of this patent is extended or adjusted under 35 U.S.C. 154(b) by 0 days.

(21) Appl. No.: 09/736,326

(22) Filed: Dec. 15, 2000

Related U.S. Application Data

(63) Continuation of application No. PCT/SE99/01088, filed on Jun. 17, 1999.

(30) Foreign Application Priority Data

Jun. 17, 1998 (SE) ..... 9802149

(51) Int. Cl.[7] ..... B67D 5/62

(52) U.S. Cl. ..... 222/146.6; 222/504; 222/190

(58) Field of Search ..... 222/146.6, 504, 222/190; 251/61.5

(56) References Cited

U.S. PATENT DOCUMENTS

| | | | | | |
|---|---|---|---|---|---|
| 4,011,896 | A | | 3/1977 | Nilon et al. | 141/82 |
| 4,094,445 | A | | 6/1978 | Bevan | 222/1 |
| 4,142,561 | A | | 3/1979 | Bennett et al. | 141/82 |
| 4,979,641 | A | | 12/1990 | Turner | 222/25 |
| 5,564,601 | A | * | 10/1996 | Cleland et al. | 222/146.6 |
| 5,603,363 | A | * | 2/1997 | Nelson | 222/146.6 |
| 5,715,700 | A | * | 2/1998 | Credle, Jr. | 222/146.6 |
| 5,875,930 | A | * | 3/1999 | Nakajima et al. | 222/146.6 |
| 5,960,701 | A | * | 10/1999 | Reese et al. | 222/146.6 |
| 6,234,763 | B1 | * | 5/2001 | Ota et al. | 251/61.5 |

FOREIGN PATENT DOCUMENTS

| | | |
|---|---|---|
| DE | 29 27 320 | 1/1981 |
| GB | 2 294 750 | 5/1996 |

* cited by examiner

*Primary Examiner*—Philippe Derakshani
*Assistant Examiner*—Thach H. Sui
(74) *Attorney, Agent, or Firm*—Burns, Doane, Swecker & Mathis, LLP

(57) ABSTRACT

A device for dispensing cold drinks including a storage vessel, a drink conduit connected thereto, and a dispensing mechanism. With a view to obtaining an unbroken cooling chain, all components in the device are enclosed in refrigerated spaces.

8 Claims, 1 Drawing Sheet

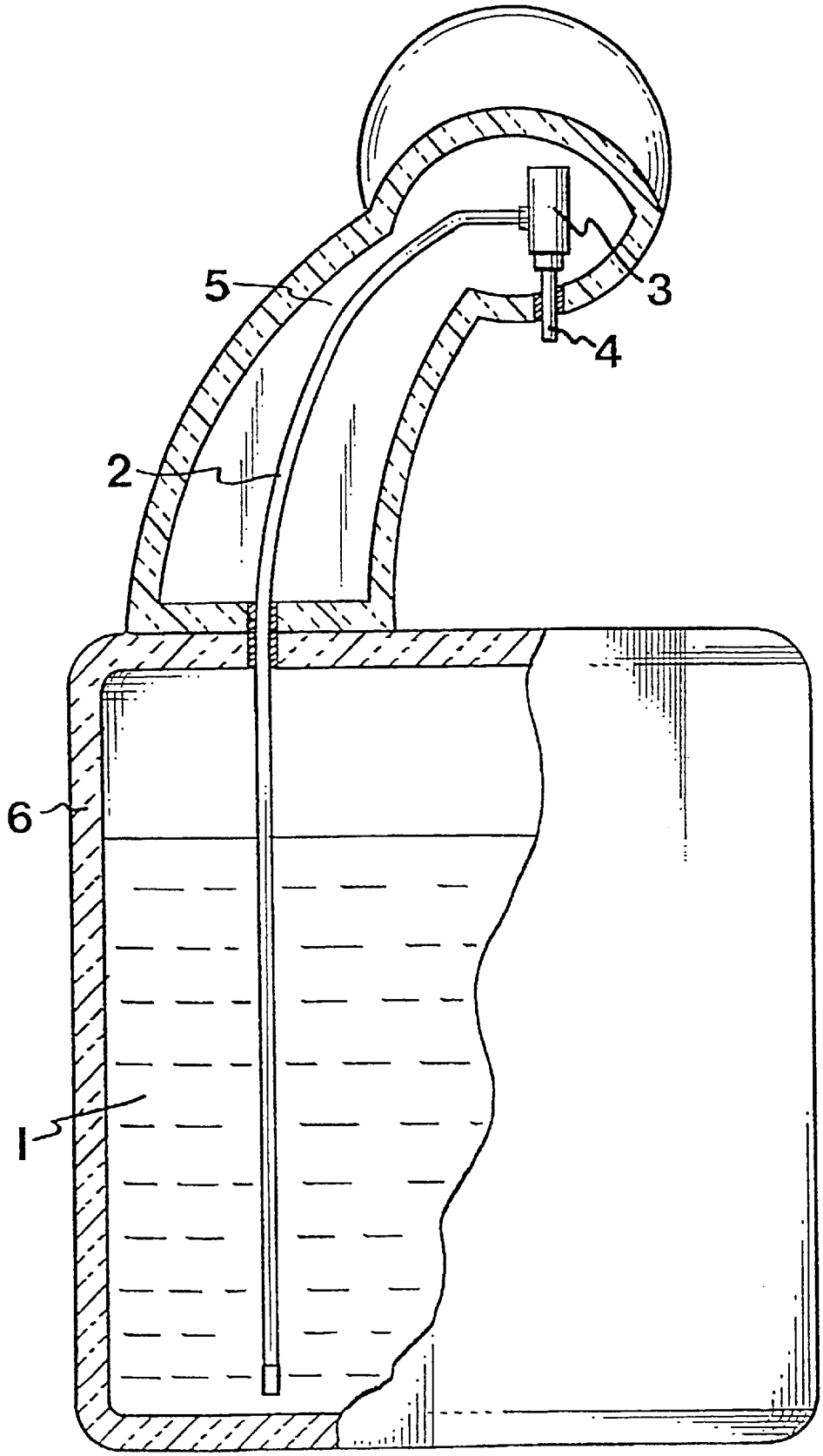
5
3
4
2
6
1

DISPENSER FOR COLD DRINKS

This is a continuation of International Application No. PCT/SE99/01088, filed Jun. 17, 1999, that designates the United States of America and was published under PCT Article 21(2) in English and which claims priority for Swedish Application No. 9802149-6, filed Jun. 17, 1998.

TECHNICAL FIELD

The present invention relates to a device for dispensing cold drinks from a drink barrel.

BACKGROUND OF THE INVENTION

Devices of the above type are previously known. Thus, U.S. Pat. No. 4,011,896 discloses an apparatus for rapidly dispensing beer into a plurality of cups, comprising a refrigerated beer barrel, a plurality of dispensing taps and lines for beer from the beer barrel to the taps, and means for cooling the beer in the lines up to the taps. In said patent specification, the importance of cooling the beer all the way up to the taps is emphasised. The actual taps, however, are not cooled. This means that the heat addition from the taps will be significant, which results in frothing. This frothing problem is solved by the inventive device by making the dispensing entirely independent of the surroundings in respect of temperature.

GB-A-2,294,750 discloses a method of dispensing beer, in which three separate cooling devices are used: a primary cooler cooling the beer adjacent to its storage tank, a secondary cooler cooling the beer adjacent to the dispensing tap, and a tertiary cooler cooling the beer within the dispensing tap. The reason for using the secondary cooler is that it is desirable to reduce the size of the tertiary cooler since it has to be visible and positioned on the counter.

U.S. Pat. No. 4,979,641 discloses a computerised drink dispensing system which has a refrigerated dispensing tap.

A further problem, which is solved according to the invention, is that the cooling chain from the drink barrel to the cup must not be broken. This is particularly important in case of drinks which are sensitive to microbiological attacks, for instance juices or frothing drinks, such as beer.

SUMMARY OF THE INVENTION

The invention thus concerns a device for dispensing cold, froth-apt, drinks of a premix type, which has the characteristic features defined by the storage vessel, the drink conduit, and the dispensing means being enclosed in a refrigerated space such that an unbroken cooling chain is obtained.

By replacing conventional dispensing taps with a refrigerated control valve by, for instance, arranging this in the refrigerated drink conduit, or in connection thereto, the great advantage is obtained that the dispensing will be independent of the surroundings in which the inventive device operates. The control valve can be set, so that the interval between the open and the closed position corresponds to an exact drink volume. By keeping all components included in the device according to the invention cooled, the quality of the drink is maintained. Examples of other advantages of the device are:

The device is adapted to intermittent, rapid dispensing of all kinds of drinks, including beer, soft drinks, juice, fruit drinks; in case of froth-apt drinks, the amount of froth can be regulated as desired by means of the control valve.

The device permits exact portioning of so-called premix products.

Rapid dispensing of all kinds of products, including froth-apt products such as beer.

Minimises the efforts in manual serving.

Permits controlled and complete self-service.

No spilling, always correct portioning.

Proper temperature of the product from the first centilitre.

Minimises the risk of spilling, always clean drink cups.

Allows dispensing of fruit drinks with much pulp.

Dispensing occurs intermittently and the drink cup need not be held during dispensing.

Easy to use.

According to a preferred embodiment which is applicable particularly to froth-apt drinks, such as beer, the control valve consists of a valve which produces an intermittently pulsating flow. According to this embodiment, it is possible to produce a certain desirable amount of froth at the end of the dispensing, for instance, into a beer mug by repeatedly opening and closing the valve during a certain (short) period of time. A pulsating flow is then obtained. The pulse time may vary from about 0.1 s to about 2 s. By exactly controlling the amount of froth, it is not necessary to let the beer stand as is customary in dispensing by means of a tap.

According to a preferred embodiment, the control valve consists of an electromagnetic flap valve.

According to other embodiments of the inventive device, it is possible to mount in the drink conduit a flow meter connected to a computer, by means of which the dispensed amount can be recorded. The flow meter with an associated computer program can be of such a type that only certain control authorities have access to the recorded drink amount. Moreover, the device according to the invention can be connected to a cash register, be suited for the preparation of a coin slot and be adapted to a charge card system.

BRIEF DESCRIPTION OF THE DRAWING

The invention will be described in more detail with reference to a preferred embodiment of the device according to the invention with reference to the accompanying drawing, whose only figure schematically shows an embodiment of the device selected as an example.

DETAILED DESCRIPTION OF THE INVENTION

As is evident from the drawing, the device comprises a drink barrel or drink vessel 1, which is refrigerated and usually pressurised for discharging the drink to the conduit 2. In case of, for instance, carbonated drinks, the gas, i.e. the carbon dioxide, can be sufficient to discharge the drink from the barrel or vessel 1. In case of, for instance, fruit drinks, the drink is discharged under pressure to the conduit 2, for instance by means of a pump. A shut-off valve (not shown) can be arranged adjacent to the connection of the conduit 2 to the vessel 1. This valve is used when changing vessels. Moreover, the device comprises a control valve 3, which in the embodiment shown is electrically or electromagnetically controlled. A dispensing pipe 4 is connected to the conduit 2 for dispensing the drink into a drink cup placed therebelow. The drink vessel 1, the control valve 3 and the drink conduit 2 are arranged according to the shown embodiment in a refrigerated space 5, 6, and the extent of the dispensing pipe 4 from the space 5 is as small as possible. When dispensing froth-apt drinks, it has been found convenient to arrange the control valve 3 essentially vertically, i.e. having an extremely small deviation from the vertical plane, so that the dispensing pipe connected to the lower portion of the control valve extends vertically. This prevents any undesirable froth produced in the control valve from remaining in the valve between the dispensing operations. If this should happen, there is a tendency to increased frothing in dispensing. By arranging the control valve and the dispensing pipe vertically, the froth is dispensed under the action of gravity in an advantageous manner. Moreover, if the inner surface of the dispensing pipe is smooth, a still better froth-dispensing effect is obtained.

The space 5, 6 can be refrigerated in a conventional manner, such as by cooling loops, cooling batteries. The technique of refrigerating is not critical according to the invention. As emphasised above, the space, in which the vessel 1 is stored, is refrigerated, such as by cooling loops, cooling batteries. With a view to keeping a low temperature, said spaces, i.e. spaces for the vessel 1, the drink conduit 2 and the control valve 3, are thermally insulated in a conventional manner.

In dispensing of drink from the device, the control valve 3 is actuated by remote control and, of course, after setting the interval between opening and closing. The temperature of the drink which is to be portioned depends in every essential respect on the type of drink. When the drink contains carbon dioxide, such as beer and soft drinks, its temperature should be kept close to the freezing point, thereby preventing too much froth from being produced in the dispensing of the drink. In case of drinks which do not contain carbon dioxide, such as juices, the temperature depends on the "drinking temperature" desired by the consumer. The temperatures are controlled in a prior art manner with the aid of temperature controlling means.

In the drink industry, use is made of premix and bag mix. In case of premix, the drink is delivered to the dispensing station in a prepared or drinkable state whereas in case of bag mix, for instance, a concentrate is delivered to the dispensing station and then water is added. The latter technique is used when pure, drinkable water can be guaranteed at the dispensing station. A typical example of premix is beer and typical examples of bag mix are juices, carbonated drinks and wine. The invention is mainly directed to cold drinks of the premix type.

What is claimed is:

1. A device for dispensing a cold froth-apt drink of premix type, comprising:

a storage vessel, a drink conduit connected to the storage vessel, and a dispensing means including a control valve for dispensing a froth-apt drink, wherein the storage vessel, the drink conduit, and the control valve are enclosed in a refrigerated space such that an unbroken cooling chain is obtained from the storage vessel and through the dispensing means and froth in the froth-apt drink may be regulated, wherein said dispensing means is arranged essentially vertically; and wherein the control valve is configured for producing an intermittent pulsating drink flow such that a desirable amount of froth may be obtained at a predetermined time in a dispensing cycle.

2. A device for dispensing a cold froth-apt drink of premix type, comprising:

a storage vessel, a drink conduit connected to the storage vessel, and a dispensing means including a control valve for dispensing a froth-apt drink, wherein the storage vessel, the drink conduit, and the control valve are enclosed in a refrigerated space such that an unbroken cooling chain is obtained from the storage vessel and through the dispensing means and froth in the froth-apt drink may be regulated, wherein said dispensing means is arranged essentially vertically, and wherein the control valve is a valve which produces an intermittently pulsating flow.

3. A device as claimed in claim 1, wherein the control valve is an electromagnetic flap valve.

4. A device as claimed in claim 1, wherein a flow meter is arranged in the drink conduit.

5. A device as claimed in claim 2, wherein the control valve is an electromagnetic flap valve.

6. A device as claimed in claim 2, wherein a flow meter is arranged in the drink conduit.

7. A device as claimed in claim 3, wherein a flow meter is arranged in the drink conduit.

8. A device as claimed in claim 5, wherein a flow meter is arranged in the drink conduit.

* * * * *